US012072158B2

(12) United States Patent
Seidl

(10) Patent No.: US 12,072,158 B2
(45) Date of Patent: Aug. 27, 2024

(54) CHAMBER OF A HANDGUN

(71) Applicant: Blaser Group GmbH, Isny (DE)

(72) Inventor: Paul Seidl, Argenbühl (DE)

(73) Assignee: Blaser Group GmbH, Isny (DE)

( * ) Notice: Subject to any disclaimer, the term of this patent is extended or adjusted under 35 U.S.C. 154(b) by 0 days.

(21) Appl. No.: 18/105,925

(22) Filed: Feb. 6, 2023

(65) Prior Publication Data

US 2023/0251052 A1 Aug. 10, 2023

(30) Foreign Application Priority Data

Feb. 7, 2022 (DE) ..... 10 2022 102 808.9

(51) Int. Cl.
*F41A 19/34* (2006.01)
*F41A 17/42* (2006.01)

(52) U.S. Cl.
CPC ..... *F41A 19/34* (2013.01); *F41A 17/42* (2013.01)

(58) Field of Classification Search
CPC ..... F41A 19/34; F41A 19/27; F41A 19/29; F41A 19/30; F41A 17/42
USPC ..... 42/14, 16, 17, 18, 2
See application file for complete search history.

(56) References Cited

U.S. PATENT DOCUMENTS 4,471,551 A 9/1984 Mattarelli
5,465,518 A 11/1995 Blaser
6,813,854 B2 * 11/2004 Popikow ..... F41A 19/39 42/42.02
7,165,350 B2 1/2007 Popikow
8,656,620 B2 * 2/2014 Hankel ..... F41A 17/42 42/69.02
8,677,666 B2 3/2014 Pichler
2001/0016997 A1 * 8/2001 Zeh ..... F41A 3/22 42/16
2005/0188577 A1 * 9/2005 Popikow ..... F41A 19/13 42/16
2023/0375296 A1 11/2023 Seidl
2023/0400273 A1 12/2023 Seidl

FOREIGN PATENT DOCUMENTS

AT 507 904 A4 9/2010
DE 3740940 A1 2/1989
DE 44 13 685 A1 10/1994
(Continued)

OTHER PUBLICATIONS

Search Report for German Application No. 10 2022 102 808.9, filed Feb. 7, 2022.
(Continued)

*Primary Examiner* — John Cooper
(74) *Attorney, Agent, or Firm* — Paul D. Bianco; Stephen Bongini; Fleit Intellectual Property Law

(57) ABSTRACT

A bolt assembly of a gun includes a bolt body displaceable along a longitudinal axis, a firing pin guided to move axially in the bolt body, a firing pin spring associated with the firing pin, and a small breech arranged at the rear end of the bolt body. A sliding sleeve actuatable by a cocking slide is arranged to cock and uncock the firing pin spring. The cocking slide contains a control cam for axial displacement of the sliding sleeve by a slide part that can be moved in a straight line in the direction of longitudinal axis of bolt body and projecting rearward relative to the small breech.

13 Claims, 4 Drawing Sheets

(56) References Cited

FOREIGN PATENT DOCUMENTS

| | | | | |
|---|---|---|---|---|
| DE | 198 10 787 | A1 | 9/1999 | |
| DE | 102 35 282 | A1 | 2/2004 | |
| DE | 10 2004 041 054 | B3 | 3/2006 | |
| DE | 20 2011 002 579 | U1 | 5/2012 | |
| DE | 10 2014 102 774 | B3 | 12/2014 | |
| DE | 20 2015 101 485 | U1 | 6/2016 | |
| EP | 0072 851 | B1 | 1/1985 | |
| EP | 0408798 | A1 | 1/1991 | |
| FR | 2846737 | A1 * | 5/2004 | ..... F41A 17/44 |
| FR | 3043767 | A1 * | 5/2017 | ..... F41A 3/42 |
| FR | 3070483 | B1 * | 9/2019 | ..... F41A 19/30 |
| RU | 2677165 | C1 | 1/2019 | |
| WO | 2021/122443 | A1 | 6/2021 | |

OTHER PUBLICATIONS

Result of Examination Report for German Patent Application No. 10 2022 102 809.7, filed Feb. 7, 2022.
Result of Examination Report for German Patent Application No. 10 2022 102 807.0, filed Feb. 7, 2022.

* cited by examiner

CHAMBER OF A HANDGUN

FIELD OF THE INVENTION

The invention relates to a bolt assembly of a gun. The invention also relates to a gun with such a bolt assembly.

BACKGROUND

A generic bolt assembly is known from DE 20 2011 002 579 U1. It comprises a bolt body rotatable about a longitudinal axis and axially displaceable in the longitudinal direction of the weapon, a firing pin axially movable in the bolt body, and a small breech arranged at the rear end of the bolt body, in which a cocking mechanism that can be actuated by a cocking slide is accommodated to cock and uncock a firing pin spring that acts on the firing pin. The cocking mechanism for cocking and uncocking the firing pin spring contains a sliding sleeve that is axially movable within the breech and a lever arrangement by means of which the sliding sleeve can be axially displaced when the cocking slide is actuated. The lever arrangement consists of an operating lever arranged within the breech so as to be pivotable about a transverse pin and an intermediate lever linked to it, which is connected to a slide part of the cocking slide extending through the rear wall of the breech into the interior of the breech. A relatively large number of parts are required for this lever arrangement in this known bolt assembly, which increase the cost and assembly effort. An elongated hole for the inward extending slide part of the cocking slide is also required on the rear side of the breech. This elongated hole must be covered by an additional cover plate to prevent contamination.

SUMMARY

One aspect of the invention relates to a bolt assembly of a gun and a gun with such a bolt assembly, in which the bolt assembly can be easily assembled and that permits simple and reliable operation with fewer parts.

Accordingly, a bolt assembly of a gun and a gun with such a bolt assembly are disclosed herein. Expedient further developments and advantageous embodiments of the invention are also disclosed herein.

The bolt assembly of a gun according to the invention contains a bolt body displaceable along a longitudinal axis, a firing pin guided so as to be axially movable in the bolt body, a firing pin spring assigned to the firing pin, and a small breech arranged at a rear end of the bolt body, in which a sliding sleeve actuatable by a cocking slide is arranged to cock and uncock the firing pin spring. The cocking slide contains a control cam for axial displacement of the sliding sleeve by means of a slide part movable in a straight line in the direction of the longitudinal axis of the bolt body and projecting rearward relative to the breech when the cocking slide is displaced between a lower uncocked position and an upper cocked position. Only a small passage opening is required in the breech due to the slide part movable in a straight line in the direction of the longitudinal axis of the bolt body. The slide part only executes a straight linear movement and therefore only requires limited space. Since the slide part also requires only a small passage opening in the bolt body, costly covers to prevent entry of contamination are also unnecessary. The passage opening can be covered by the cocking slide in all possible positions so that no additional covers or costly protective measures are necessary. A large travel path of the cocking slide is also made possible with few components in the bolt assembly according to the invention, so that simple and effective force transfer can be achieved for cocking of the firing pin spring. The cocking characteristics can also be simply altered without expensive modifications by changing the control cam within the cocking slide.

In a particularly advantageous and easy-to-assemble implementation, the slide part projecting rearward relative to the breech can be made in one piece with the sliding sleeve. The slide part in an expedient embodiment can be designed, for example, as a rearward projecting extension of the sliding sleeve. The slide part, however, can also be designed as a separate component, for example, in the form of a pin or the like. Only a small passage opening, designed, for example, as an elongated hole and running in the direction of the longitudinal axis of the bolt body, through which the rear end of the slide part extends, is necessary in the breech for the slide part.

In order to permit particularly low-friction connection between the control cam on the cocking slide and the slide part, a contact roller rotatable about a transverse axis can expediently be arranged on the rear end of the slide part for contact against the control cam.

In a further advantageous method, the slide part can be supported on a support roller mounted to rotate in the breech. A rotatable roller can also be arranged on a firing pin nut fastened on the rear end of the firing pin for guiding between the firing pin nut and the slide part.

The inclined control cam can be expediently arranged on the rear side of a downwardly narrowing triangular recess in the interior of the cocking slide. The cocking slide can be guided to move in a sloping guide groove on the back of the breech. A spring-loaded pushbutton can also be arranged in a recess on the guide groove to secure the cocking slide in an upper cocked position.

The invention also relates to a gun with the bolt assembly just described.

A control cam can be arranged on the bolt body of the bolt assembly to move a breech holding element between a lowered off-safe position to permit firing by the trigger mechanism when the bolt assembly is locked and a raised safe position to prevent firing by the trigger mechanism when the bolt assembly is unlocked. A safety against undesired discharge can thus be achieved via the bolt assembly when the bolt assembly is not locked.

BRIEF DESCRIPTION OF THE DRAWINGS

Additional details and advantages of the invention are apparent from the following description of a preferred embodiment example with reference to the drawing.

DETAILED DESCRIPTION

Figure 1:
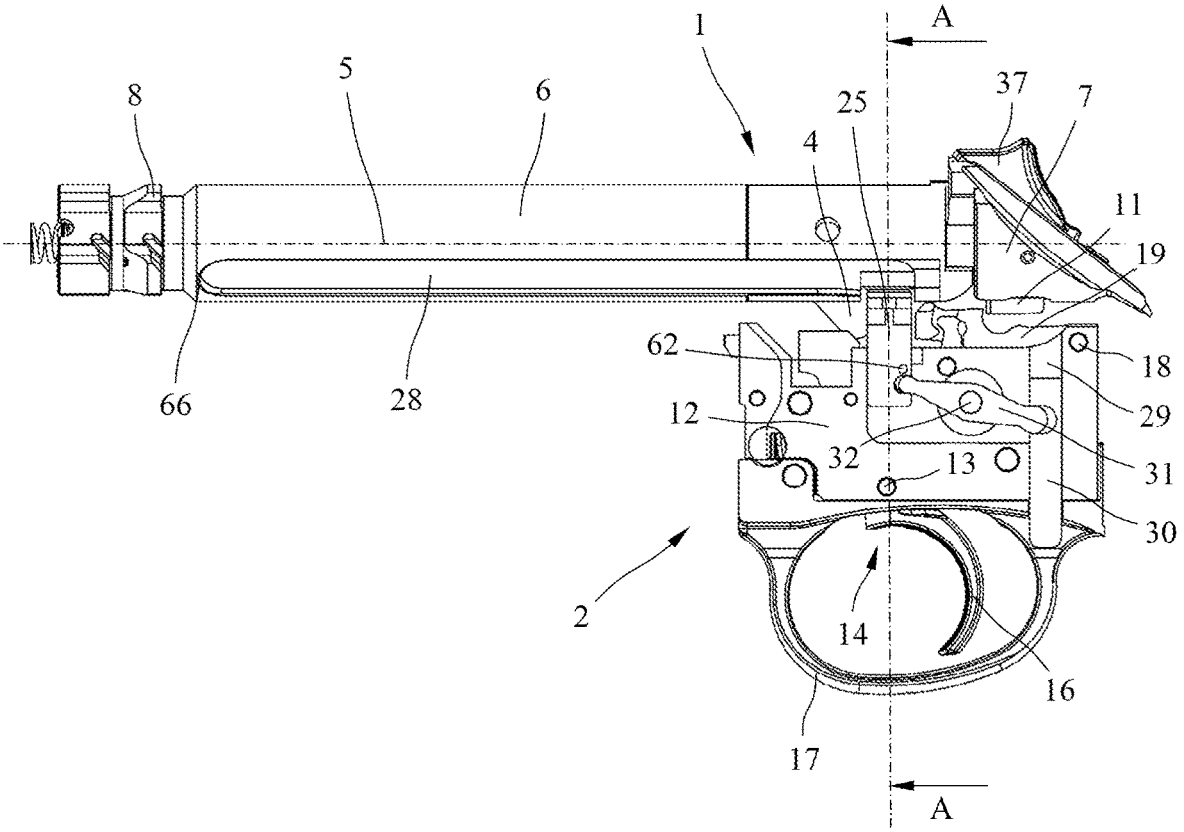
FIG. 1 shows a bolt assembly and trigger mechanism of a repeating weapon in a side view.
Figure 2:
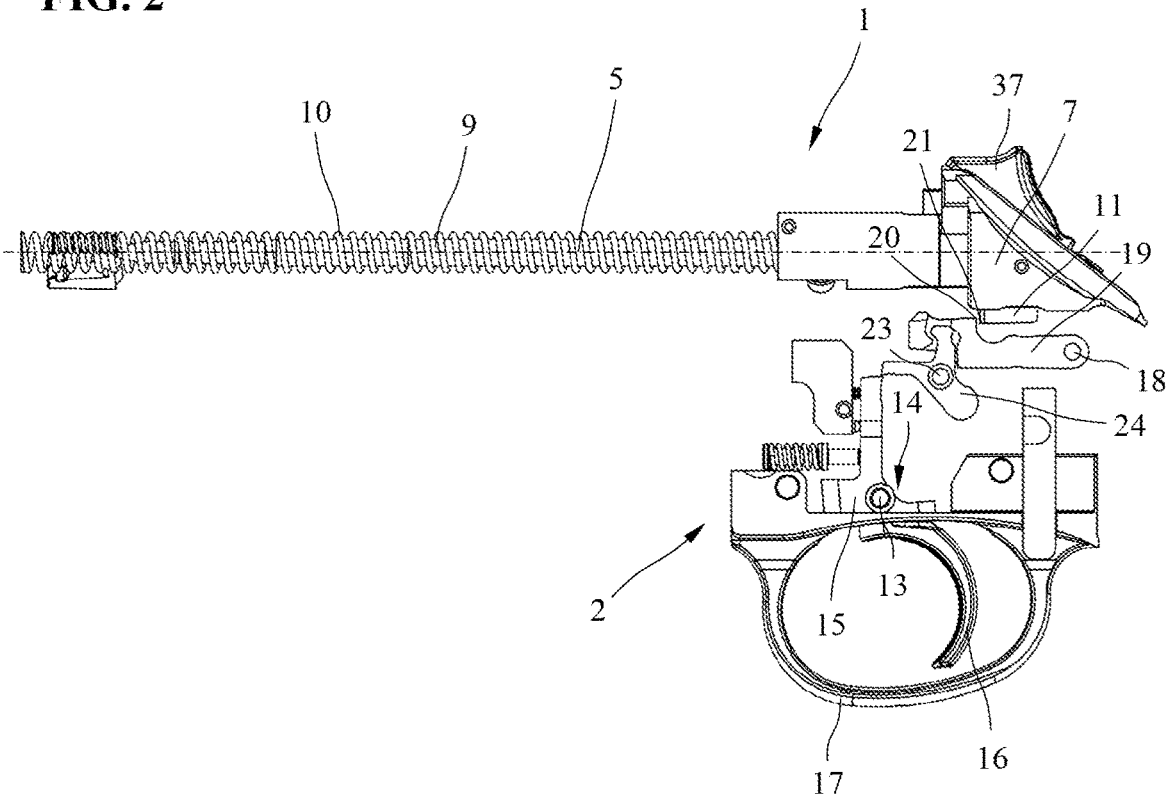
FIG. 2 shows the bolt assembly and trigger mechanism shown in FIG. 1 with blanked out parts.
Figure 3:
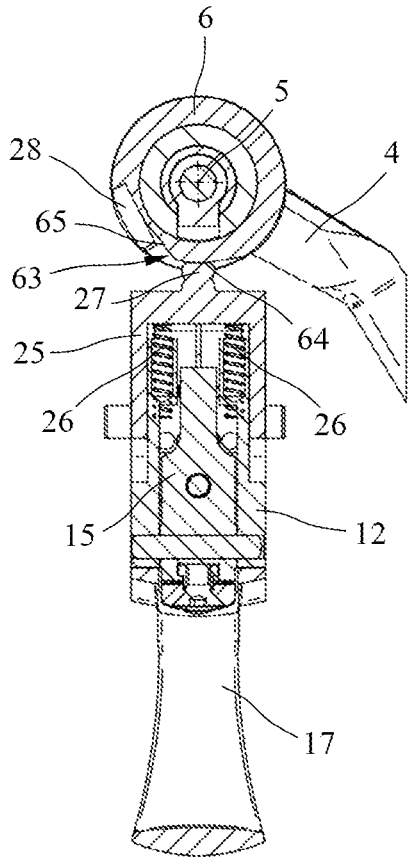
FIG. 3 shows a sectional view along line A-A of FIG. 1.

A bolt assembly 1 and a trigger mechanism 2 of a gun designed as a repeating weapon are shown in different views in FIGS. 1 to 3. The bolt assembly 1, which is guided to move in known fashion in a breech housing 3 shown in FIGS. 5 and 6, contains a cylindrical bolt body 6, which is axially movable in the direction of a longitudinal axis 5 by means of a bolt handle 4 and rotatable between a locked position and an unlocked position about the longitudinal axis 5, and a small breech 7 arranged on its rear end. Locking elements 8 designed as locking pins or the like are provided in known fashion on the front end of the cylindrical bolt body 6 to lock the bolt assembly 1 in the breech housing 3, a receiver collar, or a barrel.

An axially movable firing pin 9 shown in FIG. 2 and a firing pin spring 10 arranged coaxially around the firing pin 9 are arranged in the bolt body 6 and breech 7 of bolt assembly 1. A firing pin nut 11 axially movable within breech 7 is fastened on the rear end of the firing pin 9 viewed in the direction of firing.

Figure 7:
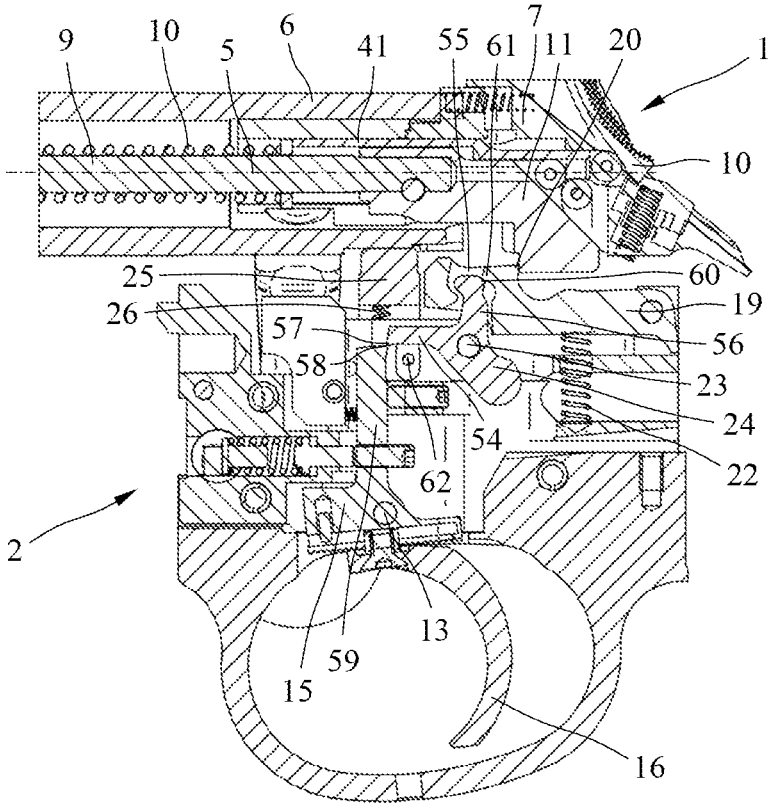
FIG. 7 shows a sectional view of the bolt assembly and the trigger mechanism in a cocked position.
Figure 8:
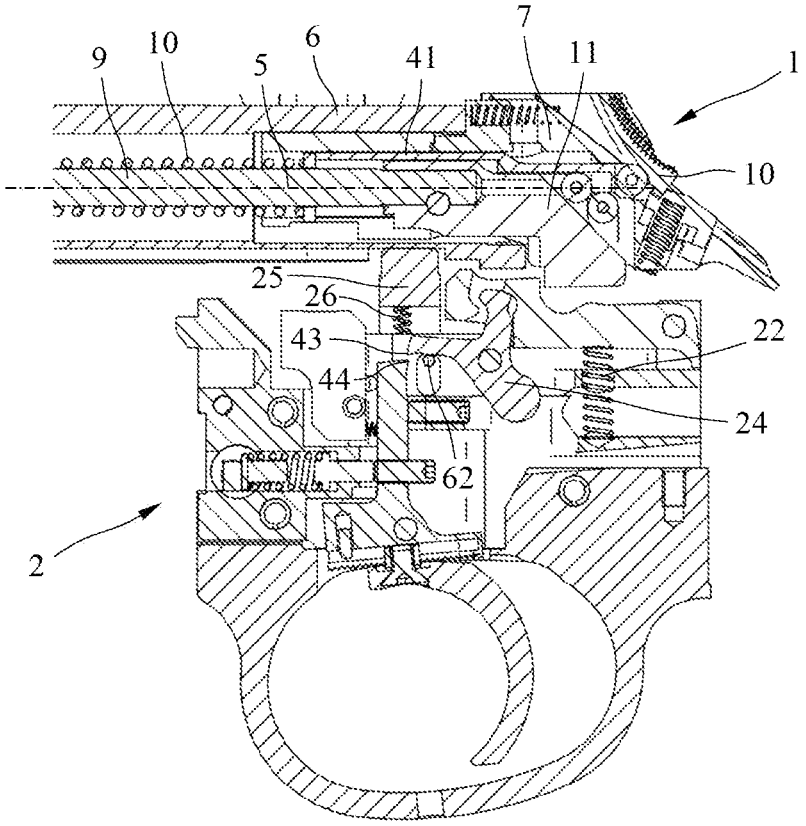
FIG. 8 shows a sectional view of the bolt assembly and the trigger mechanism in a half-cocked position.

The trigger mechanism 2 contains trigger 14 that can be pivoted about a first transverse pin 13 within a trigger housing 12, which in the depicted embodiment example consists of a trigger blade carrier 15 rotatable about the first transverse pin 13 and a trigger latch 16 releasably fastened to the bottom of trigger blade carrier 15. A trigger guard 17 is fastened to the bottom of the trigger housing 12. The trigger mechanism 2 also contains a sear 19 mounted to pivot about a second transfer pin 18 in trigger housing 12, which contains a sear stop 20, apparent in FIG. 2, to engage with a stop edge 21 of the firing pin nut 11. The sear 19 is forced upward into a cocked position in the direction of a firing pin nut 8 via a spring 22, as shown in FIGS. 7 and 8.

In order for the sear 19 to be movable by the operation of trigger 14 from its upper cocked position for securing the firing pin nut 11 into a lower half-cocked position to release the firing pin 9, according to FIG. 2, a rocker-like transfer element 24 pivotable about a third transverse pin 23 is provided within trigger housing 12 between trigger 14 and sear 19. The rocker-like transfer element 24 can be moved between a holding position to secure the sear 19 in the cocked position and a release position to move the sear 19 into the half-cocked position.

It is apparent from FIG. 1 that a fork-like breech catch element 25 is arranged on the trigger housing 12 movable transverse to bolt assembly 1. The breech catch element 25 is forced upward by compression springs 26, shown in FIG. 3, and has a pin 27 on the top to engage in a longitudinal groove 28, shown in FIG. 1, on the outside of bolt body 6. Lowering of the breech catch element 25 can occur via a control slide 30 movable in a guide groove 29 on the side of trigger housing 12 via a lever 31 rotatably mounted on trigger housing 1. Lever 31 is designed as a double-arm lever pivotable centrally about a pivot 32, so that the breech catch element 25 can be lowered by raising the control slide 30 for disassembly of bolt assembly 1. The breech catch element 25 is forced into the raised breech blocking position by the compression springs 26, shown in FIG. 3.

The breech catch element 25 can be moved by a control cam 63, shown in FIG. 3 and further explained below, on the outside of bolt body 6 between a lowered off-safe position to permit firing by trigger mechanism 2 when bolt assembly 1 is locked and a raised safe position to prevent firing by trigger mechanism 2 when bolt assembly 1 is unlocked.

Figure 4:
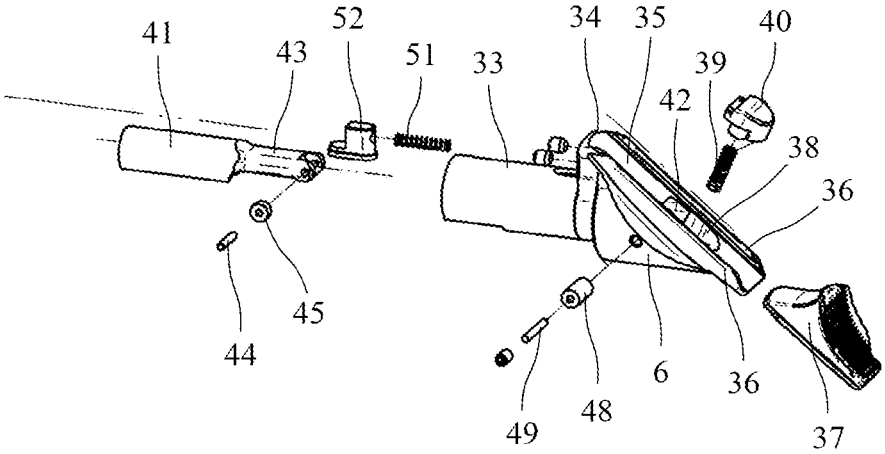
FIG. 4 shows a breech of the bolt assembly shown in FIG. 1 with a cocking slide in an exploded view.

As can be seen from FIG. 4, the small breech 7 arranged on the end of the bolt body 6 has a sleeve-like attachment 33 extending into a rear opening of the hollow cylindrical bolt body 6 and a sloped rear guide groove 34 with a T-shaped cross section with a sloping contact surface and an inward angled lateral guide wall 36 for movable guiding of a cocking slide 37. The cocking slide 37 is guided to move in guide groove 34 between a lower uncocked position, shown in FIG. 5, and an upper cocked position, shown in FIG. 6. A pushbutton 40 acted upon with a compression spring 39 is provided in a recess 38 in the contact surface 35 to secure the cocking slide 37 in the upper cocked position or to release the cocking slide 37 for its movement into the lower uncocked position. A sliding sleeve 41 cooperating with the firing pin spring 10 is also guided to move in breech 7 axially in the direction of the longitudinal axis 5 of bolt assembly 1. The sliding sleeve 41 has a slide part 43 extending through a passage opening 42 in the contact surface on its back side. In the depicted embodiment, the slide part 43 is made in one piece with the sliding sleeve as an inwardly extending thin extension. The extension in the depicted embodiment is arranged above the center axis of the slide part 43. However, the slide part 43 could also be designed as a separate component. A contact roller 45 rotatable about a transverse shaft 44 is arranged on the rear end of the slide part 43.

Figure 5:
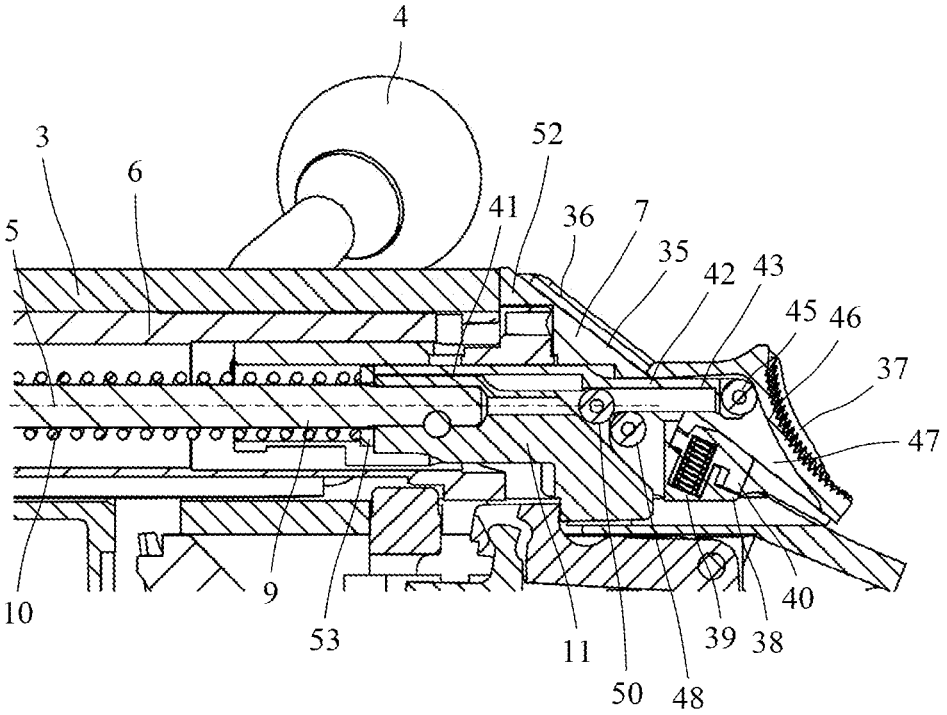
FIG. 5 shows a sectional view of the bolt assembly shown in FIG. 1 in a cocked position.
Figure 6:
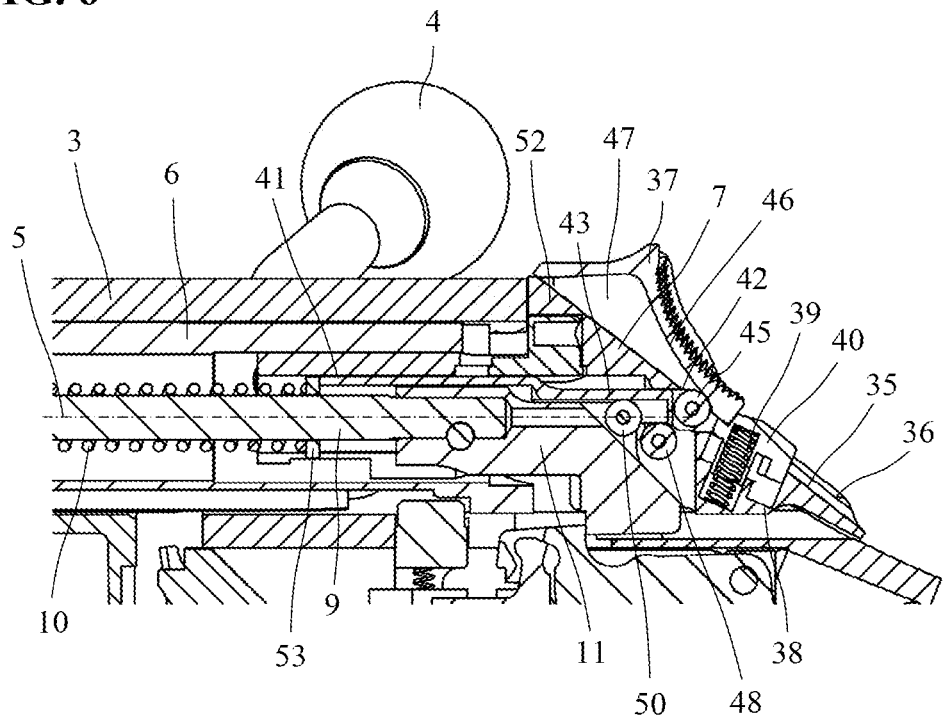
FIG. 6 shows a sectional view of the bolt assembly shown in FIG. 1 in an uncocked position.

It can be seen in FIGS. 5 and 6 that the cocking slide 37 arranged on the back of breech 7 contains an inner control cam 46 to move the sliding sleeve 41 over the slide part 43. The sloped control cam 46 is arranged on the back of a downwardly tapering triangular recess 47 in the interior of cocking slide 37. The contact roller 45 of slide part 43 lies against the control cam 46. A support roller 48, also shown in FIG. 4, which can be rotated about a transverse pin 49, is also situated in breech 7. The slide part 43 is supported to be linearly displaceable on the support roller 48. An additional rotatable roller 50, via which guiding is achieved between the firing pin nut 11 and slide part 43, is situated on the rear end of the firing pin nut 11 displaceably arranged into a downwardly open groove of the sliding sleeve 41. A catch element 52 to block breech 7, acted upon by a spring 51, is arranged in a front opening on the front side of breech 7.

The triangular recess 47 in the interior of cocking slide 37 is designed with control cam 46 so that the sliding sleeve 41 is pushed forward axially in the direction of longitudinal axis 5 during movement of cocking slide 37 from the lower uncocked position, shown in FIG. 5, through contact of the contact roller 45 rotatably mounted on the end of slide part 41 against control cam 46. The contact roller 45 then slides by rolling from the upper end to the lower end of control cam 46. During forward movement of sliding sleeve 41, a washer 53 arranged on the rear end of the firing pin spring 10 is also pushed forward, thereby cocking the firing pin spring 10. In the upper cocked position of cocking slide 37, the pushbutton 40 upwardly acted upon by compression spring 39 is also released and can move into an upper holding position to secure the cocking slide 37 in the upper cocked position. Only when the pushbutton 40 is pressed again can the cocking slide 37 be moved back into the lower uncocked position.

In FIG. 7, the trigger mechanism 2 cooperating with bolt assembly 1 is shown in a cocked position. In this figure, it can be seen that the rocker-like transfer element 24 rotatable about transverse pin 23 has a forward extending first arm 54 as viewed in the direction of firing and an upwardly projecting second arm 56 that engages in a recess 55 of sear 19.

A lower first stop 57 is provided on the front end of the upwardly projecting first arm 54 to engage with a first counter stop 58 on trigger 14. The first counter stop 58 is arranged in an upward projecting part 59 of the trigger blade carrier 15 pivotable about transverse pin 13. An upper second stop 60 is provided on the upward projecting second arm 56 of the rocker-like transfer element 24 to engage with a forward projecting second counter stop 61 in the recess 55 of sear 19. The second stop 60 on the second arm 56 of the transfer element 24 and the second counter stop 61 in the recess 55 of sear 19 are designed so that the sear 19 can be moved downward into a half-cocked position by a counter-clockwise rotation of the transfer element 24.

The trigger mechanism 2 in FIG. 7 is shown in a cocked position. The rocker-like transfer element 24 lies with its front first stop 57 on the first counter stop 58 on the upper end of the upward projecting part 59 of trigger latch 15. In this position of the rocker-like transfer element 24, the rear second stop 60 of the rocker-like transfer element 24 engages beneath the second counter stop 61 on sear 19, so that the sear 19 is held in the upper holding position. The firing pin nut 11 is held by the sear stop 20 in this upper holding position.

By retracting trigger latch 16, the first counter stop 58 on the upper end of the trigger blade carrier 15 releases the front first stop 57 on transfer element 24, so that the transfer element 24 can rotate counterclockwise and the front first arm 54 can move downward. The second stop 60 on the second arm 56 of transfer element 24 then disengages from the second counter stop 61 on sear 19, so that the sear 19 can be rotated into the lower half-cocked position to release the firing pin 9 acted upon by firing pin spring 10.

FIG. 7 also shows that a blocking element 62, here in the form of a pin, is arranged on the breech catch element 25, which can be displaced transversely to bolt assembly 1, which cooperates with the forward projecting first arm 54 of transfer element 24 to block or release trigger 14. In a lowered off-safe position of breech catch element 25, shown in FIG. 7, the blocking element 62 is spaced from the bottom of the first arm 56, so that the transfer element 24 can be rotated counterclockwise to discharge a shot. In a raised safe position of breech catch element 25, as shown in FIG. 8, on the other hand, the front first arm 56 of transfer element 24 is forced upward by the blocking element 62, so that the transfer element 24 cannot be rotated clockwise into its release position, and sear 19 is held in its upper cocked position.

When bolt body 6 is rotated into an unlocked position from a lowered off-safe position, shown in FIG. 7, by raising of bolt stem 4, the breech catch element 25 is moved into a raised safe position, shown in FIG. 8, via a control cam 63, which can be seen in FIG. 3, designed as a radial groove on the outside of bolt body 6. A control cam 63 has a first control surface 64 on which the upper pin 27 of the breech catch element 25 forced upward by compression springs 26 stops in a blocked position of bolt body 6 and by means of which the breech catch element 25 is forced into the off-safe position. The control cam 63 also has a second control surface 65 following the first control surface 64 in the peripheral direction of bolt body 6 and recessed relative to it, on which the upper pin 27 of the breech catch element 25 forced upward by compression springs 26 stops when bolt body 6 is unlocked and by means of which the breech catch element 25 reaches the raised safe position.

In the locking position of bolt assembly 1, shown in FIG. 3, the breech catch element 25 forced upward by the two compression springs 26 lies with its upper pin 27 against the first control surface 64 and is forced downward by it into the off-safe position, shown in FIG. 7. In the off-safe position, the pin-like blocking element 62 is spaced from the bottom of the forward projecting arm 54 of the rocker-like transfer element 24, so that the rocker-like transfer element 24 can be rotated counterclockwise when trigger 14 is operated, and the firing pin nut 11 arranged on the end of firing pin 9 can be released for half-cocking of the firing pin 9 via sear stop 20.

If, on the other hand, the bolt stem 4 is raised in the locking position shown in FIG. 3 to unlock bolt assembly 1, and the bolt body 6 is therefore rotated counterclockwise, as viewed in the firing direction, pin 27 on the top of the breech catch element 25 comes against the second control surface 65 of control cam 63 offset inward relative to the first control surface 64, so that the breech catch element 25 can move upward into the raised safe position under the action of springs 26.

In the completely unlocked position of bolt assembly 1, pin 27 reaches the longitudinal groove 28 of bolt body 6 running in the longitudinal direction, so that the bolt assembly 1 can be pulled rearward to open the breech. The longitudinal groove 28 has a stop surface 66, shown in FIG. 1, on its front for stopping of pin 27 of the breech catch element 25. This prevents the bolt assembly 1 from being completely pulled out of the collar during repeated firing. For disassembly of bolt assembly 1 the breech catch element 25 can be moved by the control slide 30 into a lowered disassembly position via lever 31.

LIST OF REFERENCE NUMBERS

1 Bolt assembly
2 Trigger mechanism
3 Breech housing
4 Bolt stem
5 Longitudinal axis
6 Bolt body
7 Small breech
8 Locking element
9 Firing pin
10 Firing pin spring
11 Firing pin nut
12 Trigger housing
13 First transverse pin
14 Trigger
15 Trigger blade carrier
16 Trigger latch
17 Trigger guard
18 Second transverse pin
19 Sear
20 Sear stop
21 Stop edge
22 Spring
23 Third transverse pin
24 Transfer element
25 Breech catch element
26 Compression spring
27 Pin
28 Longitudinal groove
29 Guide groove
30 Control slide
31 Lever
32 Pivot
33 Attachment
34 Guide groove
35 Contact surface

36 Guide wall
37 Cocking slide
38 Recess
39 Compression spring
40 Pushbutton
41 Sliding sleeve
42 Passage opening
43 Passage opening
44 Slide part
43 Slide part
44 Transverse shaft
45 Contact roller
46 Control cam
47 Recess
48 Support roller
49 Transverse pin
50 Roller
51 Spring
52 Blocking element
53 Washer
54 First arm
55 Recess
56 Second arm
57 First stop
58 First counter stop
59 Upper part of trigger blade carrier
60 Second stop
61 Second counter stop
62 Blocking element
63 Control cam
64 First control surface
65 Second control surface
66 Stop surface

The invention claimed is:

1. A bolt assembly of a gun, the bolt assembly comprising:
a bolt body displaceable along a longitudinal axis;
a firing pin that is guided to be axially movable in the bolt body;
a firing pin spring assigned to the firing pin;
a breech arranged at a rear end of the bolt body with respect to a direction of firing; and
a sliding sleeve actuatable by a cocking slide for cocking and uncocking of the firing pin spring,
wherein the cocking slide includes a control cam for axial displacement of the sliding sleeve by a slide part that can be moved in a straight line in a direction of the longitudinal axis of the bolt body when the cocking slide is moved between a lower uncocked position and an upper cocked position, the slide part projecting rearward relative to the breech.

2. The bolt assembly of a gun according to claim 1, wherein the slide part is formed in one piece with the sliding sleeve.

3. The bolt assembly of a gun according to claim 1, wherein the slide part is designed as a rearwardly projecting extension of the sliding sleeve.

4. The bolt assembly of a gun according to claim 1, wherein a rear end of the slide part extends through a passage opening of the breech, the passage opening running in the direction of the longitudinal axis of the bolt body.

5. The bolt assembly of a gun according to claim 1, wherein a contact roller rotatable about a transverse axis is arranged on a rear end of the slide part for contact against the control cam.

6. The bolt assembly of a gun according to claim 1, wherein the slide part is supported on a support roller that is rotatable in the breech.

7. The bolt assembly of a gun according to claim 1, wherein a rotatable roller is arranged on a firing pin nut that is fastened to a rear end of the firing pin for guiding between the firing pin nut and the slide part.

8. The bolt assembly of a gun according to claim 1, wherein the control cam is sloped and arranged on a rear side of a downwardly narrowing triangular recess in an interior of the cocking slide.

9. The bolt assembly of a gun according to claim 1, wherein the cocking slide is displaceably guided in an inclined guide groove on a rear side of the breech.

10. The bolt assembly of a gun according to claim 9, wherein a spring-loaded pushbutton is arranged in a recess on the guide groove to secure the cocking slide in the upper cocked position.

11. A gun comprising:
the bolt assembly according to claim 1; and
a trigger mechanism.

12. The gun according to claim 11, wherein a second control cam is arranged on the bolt body of the bolt assembly to move a breech catch element between a lowered off-safe position to allow firing by the trigger mechanism when the bolt assembly is locked and a raised safe position to prevent firing by the trigger mechanism when the bolt assembly is unlocked.

13. A gun comprising:
bolt assembly including a bolt body that is displaceable along a longitudinal axis;
a firing pin that is guided to be axially movable in the bolt body;
a firing pin spring assigned to the firing pin;
a breech arranged at a rear end of the bolt body with respect to a direction of firing; and
a sliding sleeve actuatable by a cocking slide for cocking and uncocking of the firing pin spring,
wherein the cocking slide includes a control cam for the axial displacement of the sliding sleeve by a slide part that is movable in a straight line in a direction of the longitudinal axis of the bolt body when the cocking slide is moved between a lower uncocked position and an upper cocked position, the slide part projecting rearward relative to the breech.

* * * * *